US007219675B2

(12) United States Patent
Brust

(10) Patent No.: US 7,219,675 B2
(45) Date of Patent: May 22, 2007

(54) CLEANING COMPOSITION AND METHOD

(76) Inventor: Robert Brust, 228 Winding Oak La., Buffalo Grove, IL (US) 60089

( * ) Notice: Subject to any disclaimer, the term of this patent is extended or adjusted under 35 U.S.C. 154(b) by 319 days.

(21) Appl. No.: 10/951,153

(22) Filed: Sep. 27, 2004

(65) Prior Publication Data

US 2006/0074000 A1 Apr. 6, 2006

(51) Int. Cl.

| | |
|---|---|
| ***B08B 9/02*** | (2006.01) |
| ***B08B 9/027*** | (2006.01) |
| ***B08B 3/04*** | (2006.01) |
| ***C11D 3/02*** | (2006.01) |
| ***C11D 3/37*** | (2006.01) |

(52) U.S. Cl. ..... 134/22.11; 134/8; 134/22.13; 134/22.14; 134/22.17; 134/22.19; 134/39; 134/42; 510/109; 510/199; 510/382; 510/405

(58) Field of Classification Search ..... 510/109, 510/199, 382, 405; 134/8, 22.11, 22.13, 134/22.14, 22.17, 22.19, 39, 42
See application file for complete search history.

(56) References Cited

U.S. PATENT DOCUMENTS

2005/0202996 A1* 9/2005 Waits et al. ..... 510/475

* cited by examiner

*Primary Examiner*—Brian Mruk
(74) *Attorney, Agent, or Firm*—Olson & Hierl, Ltd.

(57) ABSTRACT

A novel cleaning composition comprises a dilutant, a wetting agent, a chelating agent, an alkaline builder, and a chlorine provider. The dilutant is preferably water. The wetting agent is alkoxylated alcohol. The chelating agent is an acrylic/maleic acid copolymer. The alkaline builder is sodium hydroxide. The chlorine provider is sodium hypochlorite. A method comprises the steps of partially filling the whirlpool tub with water, activating the whirlpool pump to circulate the water, adding to the circulating water a cleaning composition comprising a dilutant, a wetting agent, a chelating agent, an alkaline builder, and a chlorine provider, running the whirlpool pump for a predetermined time to circulate the water and cleaning composition thoroughly through the internal plumbing, and draining the whirlpool tub completely.

5 Claims, No Drawings

CLEANING COMPOSITION AND METHOD

BACKGROUND OF THE INVENTION

This invention pertains to a cleaning composition and, more particularly, to a cleaning composition for the cleaning from the internal pipes of a whirlpool tub of mold, mildew, bacteria and other foreign matter that thrive in that environment.

Whirlpool tubs and spas are becoming increasingly common in homes. Not long ago, whirlpool tubs were considered to be a luxury. Today, the whirlpool tub is frequently standard in many more expensive homes and is one of the most popular items considered when remodeling a master bathroom. During operation, the whirlpool tub is filled with warm water, which circulates by a pump through internal plumbing, to soothe and relax the user. When the whirlpool tub is turned off water is normally drained from the tub itself. However, water remains in the internal pipes and such standing water is an excellent source for the growth of mold, mildew and bacteria. Various cleaners have been employed to remove the mold, mildew, and bacteria, for example, chlorine and water, however, the commercially available cleaning agents have not been found to be satisfactory, particularly where the water has higher than normal mineral content.

An object of the present invention is to provide an improved cleaning composition for an indoor whirlpool tub that will function with water of varying mineral contents to thoroughly clean the internal plumbing of mold, mildew, and bacteria.

Another object of the present invention is to provide an improved method of cleaning an indoor whirlpool tub of mold, mildew, and bacteria using a cleaning composition that will condition the water by tying up the mineral content and iron in the water.

Other objects and advantages of the present invention will be made more apparent hereinafter.

SUMMARY OF THE INVENTION

The present invention comprises a cleaning composition that includes a dilutant, a wetting agent, a chelating agent, an alkaline builder, and a chlorine provider and a method of using such cleaning composition to clean a whirlpool or spa. Preferably, the dilutant is water, the wetting agent is alkoxylated alcohol, the chelating agent is an acrylic/maleic acid copolymer, the alkaline builder is sodium hydroxide, and the chlorine provider is sodium hypochlorite. In a desirable cleaning composition, the dilutant comprises 79.6% to 97.4% by weight, the wetting agent comprises 0.01% to 2% by weight, the chelating agent comprises 0.05% to 2.5% by weight, the alkaline builder comprises 2.0% to 10% by weight, and the chlorine provider comprises 0.06% to 11.9% by weight.

DETAILED DESCRIPTION OF THE PRESENT INVENTION

Standing water in the internal plumbing of a whirlpool tub can be a breeding ground for mold, mildew and bacteria. To overcome the problem I have developed a cleaning composition and method for cleaning whirlpool tubs that is suited for all types of water, including water with higher concentrations of mineral content and iron, on the order of over 200 mg/L or 12 grams/gallon.

The novel cleaning compound comprises a dilutant, a wetting agent, a chelating agent, an alkaline builder, and a chlorine provider. The dilutant is preferably water. The wetting agent is alkoxylated alcohol, which will allow the water to penetrate the mold and grime and break it up. One example of a suitable wetting agent is T-Det 416LF, which is manufactured by Harcros Chemicals, Inc. and which contains no water. The chelating agent is an acrylic/maleic acid copolymer, which will bind or tie up the mineral compounds and iron and permit the bleach to do its work. One example of a suitable chelating agent is Acrysol 505N, which is manufactured by Rohm & Haas and which contains 40% water. The alkaline builder is sodium hydroxide, which will help to break down the dirt. The chlorine provider is sodium hypochlorite, which will help to bleach and clean the surfaces of the internal piping.

Cleaning compositions within the following parameters would produce desirable results: the dilutant comprises 79.6% to 97.4% by weight, the wetting agent comprises 0.01% to 2% by weight, the chelating agent comprises 0.05% to 2.5% by weight, the alkaline builder comprises 2.0% to 10% by weight, and the chlorine provider comprises 0.06% to 11.9% by weight, taking into account the constituent components as described above.

A specific cleaning composition found to produce favorable results comprises the following percentages of each active constituent per 100 gallons of composition: the dilutant comprises about 18.2%, the wetting agent comprises about 0.3%, the chelating agent comprises about 2.2%, the alkaline builder comprises about 4% and the chlorine provider comprises about 75.4%. When considering the overall composition, the following percentages result: the water comprises 86.9% by weight, the alkoxylated alcohol comprises 0.3% by weight, the acrylic/maleic acid copolymer comprises 1.3% by weight, the sodium hydroxide comprises about 2.0% by weight, and the chlorine comprises about 9.5% by weight.

The method comprises the steps of filling the whirlpool tub to be cleaned with water to within about two inches of the overflow drain. A normal whirlpool tub for home use for a single person contains about 55–65 gallons of water. The pump is turned on to circulate the water. The cleaning composition, about 12 ounces for an initial cleaning, is poured into the circulating water and the pump is operated for a predetermined time, about 30–40 minutes. At the end of the predetermined time, the pump operation is terminated and the whirlpool tub is drained. After the initial cleaning, about 8 ounces of cleaning composition should be used to maintain whirlpool tub cleanliness. For a larger two person whirlpool tub, which contains about 80–90 gallons of water, 12 ounces of cleaning composition are recommended for the initial cleaning and 10 ounces of cleaning composition are recommended to maintain whirlpool tub cleanliness.

The novel composition of the present invention has been found to produce satisfactory cleaning results with normal water and even with water that contains iron and high mineral content.

While I have disclosed a presently preferred embodiment of the present invention, it will be apparent to persons skilled in the art that the invention may be otherwise embodied within the scope of the following claims.

I claim:

1. A cleaning composition comprising a dilutant, a wetting agent, a chelating agent, an alkaline builder, and a chlorine provider, wherein said dilutant is water, said wetting agent is alkoxylated alcohol, said chelating agent is an acrylic/maleic acid copolymer, said alkaline builder is sodium hydroxide, said chlorine provider is sodium hypochlorite, and wherein said dilutant comprises 79.6% to 97.4% by weight, said wetting agent comprises 0.01% to 2% by weight, said chelating agent comprises 0.05% to 2.5% by weight, said alkaline builder comprises 2.0% to 10% by weight, and said chlorine provider comprises 0.06% to 11.9% by weight.

2. A cleaning composition comprising a dilutant, a wetting agent, a chelating agent, an alkaline builder, and a chlorine provider, wherein said dilutant is water, said wetting agent is alkoxylated alcohol, said chelating agent is an acrylic/maleic acid copolymer, said alkaline builder is sodium hydroxide, said chlorine provider is sodium hypochlorite, wherein for each 100 gallons, the dilutant comprises approximately 86.9% by weight, the alkoxylated alcohol comprises approximately 0.3% by weight, the acrylic/maleic acid copolymer comprises approximately 1.3% by weight, the sodium hydroxide comprises approximately 2% by weight and the sodium hypochlorite comprises approximately 9.5% by weight.

3. A method of cleaning whirlpool tub internal plumbing comprising the steps of partially filling the whirlpool tub with water, activating the whirlpool pump, adding to the circulating water a cleaning composition comprising a dilutant, a wetting agent, a chelating agent, an alkaline builder, and a chlorine provider, wherein said dilutant is water, said wetting agent is alkoxylated alcohol, said chelating agent is an acrylic/maleic acid copolymer, said alkaline builder is sodium hydroxide, said chlorine provider is sodium hypochlorite, and wherein said, dilutant comprises 79.6% to 97.4% by weight, said wetting agent comprises 0.01% to 2% by weight, said chelating agent comprises 0.05% to 2.5% by weight, said alkaline builder comprises 2.0% to 10% by weight, and said chlorine provider comprises 0.06% to 11.9% by weight, running the whirlpool pump for a predetermined time to circulate the water and cleaning composition thoroughly through the internal plumbing, and draining the whirlpool tub completely.

4. A method of cleaning whirlpool tub internal plumbing comprising the steps of partially filling the whirlpool tub with water, activating the whirlpool pump, adding to the circulating water a cleaning composition comprising a dilutant, a wetting agent, a chelating agent, an alkaline builder, and a chlorine provider, wherein said dilutant is water, said wetting agent is alkoxylated alcohol, said chelating agent is an acrylic/maleic acid copolymer, said alkaline builder is sodium hydroxide, and said chlorine provider is sodium hypochlorite, and wherein for each 100 gallons, the dilutant comprises approximately 86.9% by weight, the alkoxylated alcohol comprises approximately 0.3% by weight, the acrylic/maleic acid copolymer comprises approximately 1.3% by weight, the sodium hydroxide comprises approximately 2% by weight and the sodium hypochlorite comprises approximately 9.5% by weight, running the whirlpool pump for a predetermined time to circulate the water and cleaning composition thoroughly through the internal plumbing, and draining the whirlpool tub completely.

5. The method of claim 4, wherein 10 ounces of cleaning composition are added to the circulating water for each cleaning of the whirlpool tub internal plumbing.

* * * * *